US006053881A

United States Patent [19]

Boodramsingh et al.

[11] Patent Number: 6,053,881

[45] Date of Patent: Apr. 25, 2000

[54] ANKLE MASSAGING DEVICE

[76] Inventors: Anil Boodramsingh; Michele Ribalaigua, both of 9272 SW. 132nd St., Miami, Fla. 33176

[21] Appl. No.: 09/079,832

[22] Filed: May 15, 1998

[51] Int. Cl.[7] ..... A61H 1/00; A61H 23/02

[52] U.S. Cl. ..... 601/70; 601/79; 601/133; 601/134; 606/204

[58] Field of Search ..... 601/46, 70–4, 601/79–81, 133–5; 606/204

[56] References Cited

U.S. PATENT DOCUMENTS 4,343,303 8/1982 Williams .
4,878,489 11/1989 Kamayachi .
5,094,227 3/1992 Eglauf et al. .
5,327,886 7/1994 Chiu .
5,569,168 10/1996 Hartwig .
5,746,702 5/1998 Gelfgat et al. .

*Primary Examiner*—Danton D. DeMille
*Attorney, Agent, or Firm*—Joseph N. Breaux

[57] ABSTRACT

An ankle massaging device which is constructed in the general shape of a "U" while the curved position of the massaging device rests on a top of a user's foot, each end of the massaging device is positioned on opposite sides of a user's ankle while battery powered massaging devices are located in each end of the device and soft massaging protrusions are located on interior surfaces of the ends and corresponds with menstrual cycle pressure points located on a user's ankle whereby the massaging device helps relieve menstrual cycle cramps for the user.

3 Claims, 2 Drawing Sheets

ANKLE MASSAGING DEVICE

TECHNICAL FIELD

The present invention related to devices and methods for massaging and more particularly to a device and method for ankle massaging which device massage pressure points of a woman's ankle to help relieve menstrual cycle cramps.

BACKGROUND ART

Numerous prior art devices have been disclosed which provide devices and methods for massaging different portions of a human body. These prior art devices provide effective means for massaging particular body parts, however to date, there has never been a massaging device for massaging the ankles of a woman for the purposes of relieving menstrual cycle cramps as the present invention.

As will be shown below, the present invention is constructed in a shape of a "U" and includes a pair of vibrating motor units attached to each leg of the "U". The unit wraps around a user's ankle while vibrating mechanisms are positioned to vibrate and massage pressure points associated with menstrual cycle cramp relief. The massaging units include comfort rubber protruding portions which contact the user's pressure points. The invention allows a women to relieve her menstrual cycle cramps without the need of bending over and rubbing her ankles, or seeking the assistance of a second person. The prior art patents which have claimed and disclosed vibrating massage apparats are as follows:

Xiao, U.S. Pat. No. 5,374,238 discloses a vibrating neck rest for a passenger seat of a motor vehicle.

Rojas, U.S. Pat. No. 4,802,463 discloses a foot massager which vibrates and massages a user's foot by the user placing a sole of a user's foot on a vibrating platform member which extends the length of the foot sole.

Gardner, et al, U.S. Pat. No. 4,614,179 discloses a medical appliance for artificially stimulating blood flow through a user's foot by providing pulsed squeezing of the foot and blood veins in a user's foot.

Leach, U.S. Pat. No. 3,009,460 discloses a vibratory device for placement within a couch, leg rest, or ottoman thereby massaging the body part which is placed on the furniture.

Walters, U.S. Pat. No. 2,542,221 discloses a foot massaging and vibrating device.

Mueller, et al. U.S. Pat. No. 2,081,365 discloses a foot vibrator wherein a user's foot is strapped to a platform vibrated by concentric shaft rotation.

As will be detailed below the present device provides an effective massaging device which not only provides comfort to the user but also an effective means for relieving menstrual cycle cramps.

GENERAL SUMMARY DISCUSSION OF INVENTION

It is thus an object of the invention to provide a Ankle Massaging Device that assists a female user in diminishing menstrual cycle cramps.

It is a further object of the invention to provide a Ankle Massaging Device that is constructed in a general shape of a "U" with two motorized massaging units mounted in each leg of the device while an inside surface portion of each leg comprises a multiplicity of massaging protrusions which contact a user's pressure points associated with menstrual cycle cramp pressure points thereby massaging the user's menstrual cycle pressure point's and relieving menstrual cycle cramps.

It is a still further object of the invention to provide an Ankle Massaging Device which is portable, cost effectively manufactured and adaptable for use on either ankle of a user.

Accordingly, a Ankle Massaging Device is provided which is constructed in the general shape of a "U" while each leg of the "U" contains a battery powered massaging device which has a massaging motion concentrated at a multiplicity of massaging protrusions located on an inside surface of each leg. The massaging protrusions are positioned to contact menstrual cycle cramp pressure points so that a user may diminish menstrual cramps by use of the massaging device. The device further includes a an on/off electrical switch and an interior storage area for batteries which power the unit. A curve portion of the "U" shaped device provides a spring means for urging each leg together while a user separates the legs to insert the device over her ankle, the spring force holds the device in place on the user's ankle while in use, also the curved portion rests on a top of the user's foot while the device is in use.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that the ankle massaging device is most useful for a woman who experiences menstrual cycle cramps. It is know by those skilled in the art that menstrual cycle cramps may be relieved by the massaging of appropriate pressure points located on each side of an afflicted woman's ankles. The performance of an ankle massage for purposes of relieving menstrual cycle cramps is most effectively accomplished by a second person since the afflicted person is usually unmotivated to bend over to accomplish the task since the motion results in increased cramp pain. The present device provides an effective means for allowing the user to comfortably position herself while the massaging takes place without the need for assistance.

Figure 1:
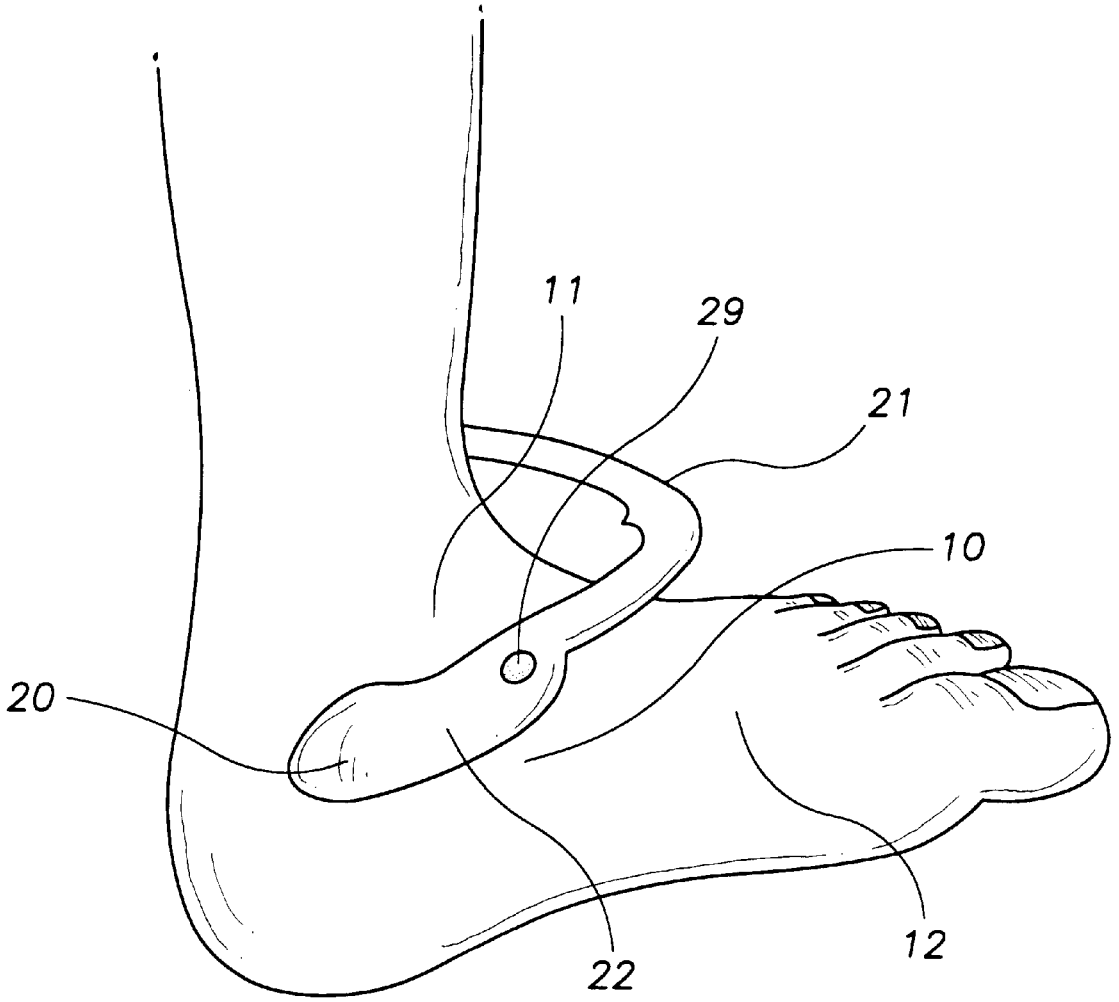
FIG. 1 is an illustration of the ankle massaging device positioned on the ankle of a user while the curve position of the device rests on the top of the user's foot.
Figure 2:
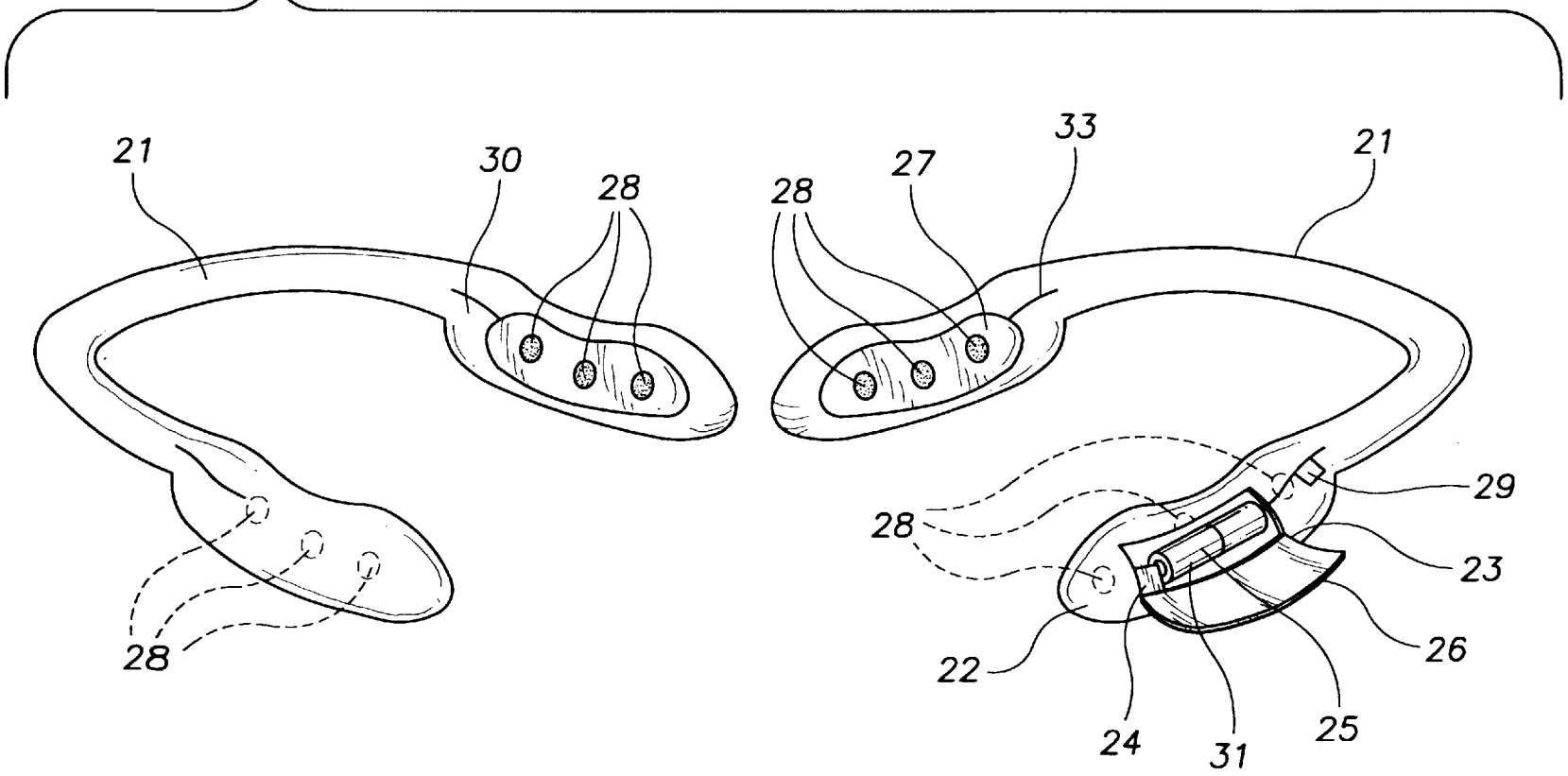
FIG. 2 is an illustration with a mirror image of the ankle massaging device illustrating the placement of massaging protrusions on an inside surface of each leg of the device, while also illustrating the internal placement of batteries for powering the massaging device.

Referring to the figures in detail FIG. 1 illustrates a user's ankle 10 with the ankle massaging device 20 appropriately placed on the user's ankle. The pressure points 11 on a user's ankle are located on both sides of the ankle. The massaging device 20 is constructed in the general shape of a "U" thereby positioning each leg of the "U" 22 on either side of an ankle 10. The curved section 21 of the massaging device 20 provides a means for connecting each leg 22 of the device together while also providing an adjustable means for fitting the device on ankle's of differing dimensions. The curve section 21 preferably includes a biasing means which urges each leg 22 of the massaging device together which results in a clamping means around a user's ankle. The construction of the device is preferably one piece plastic molded while the curves section 21 is molded and constructed of material that spring back to its original shape, which provides the biasing means which urges each leg 22 together. The construction material is preferable high density polymer and has sufficient flexibility to resist cracking when the legs are separated. The user separates the legs 22 and inserts her ankle 10 to install the device.

An inside surface 30 of the massaging device ends 22 are mirror images of each other while the ends 22 also contain a massaging device mechanism 24, power supply 31, and further include massaging protrusions 28. The massaging device ends 22 are preferably constructed of material which is continuous with the curve portion 21. Additionally, the entire massage device is preferably constructed of water proof material. An inside surface 30 which includes the massaging protrusion 28 is preferable constructed of a comfortable resilient material such as neoprene. An massaging protrusions 28 are preferable slightly raised area on the inside surface 30 and are preferably raised about one quarter to about one half inch from the surface 30. The protrusions 28 may also have a surface which includes a multiplicity a smaller raised portions which provide additional massaging action. Placement of the massaging protrusions 28 coincide with the pressure point locations 11 on the ankle 10 for relieving menstrual cycle cramps.

The legs 22 further include an internal cavity 23 for receiving power supply 31 such as batteries 25 and the massaging device mechanism 24. An access door 26 is provided for easily replacing the batteries of the massaging device. Batteries are provide in one leg of the device while wiring 33 extends to the other leg for powering the massaging mechanism 24. An on/off switch 29 is provided in a convenient location on the device. The power supply 31 may also include AC current supplied by regular household utilities. A massaging mechanism 24 is contained in each leg interior cavity 23 while each massaging mechanism 24 is preferably identical. The massaging mechanisms 24 provide a vibrating motion directed to each massaging protrusion 28 and is preferably a vibrating electric motor.

When the device is placed on a user's ankle, the device ends 22 are separated and allowing the device to be placed around the ankle 20 with the curved section 21 placed on top 12 of a user's foot. The device is then activated and allowed to massage and vibrate the pressure points for relieving menstrual cycle cramps.

It is noted that the embodiment of the Ankle Massaging Device described herein in detail for exemplary purposes is of course subject to many different variations in structure, design, application and methodology. Because many varying and different embodiments may be made within the scope of the inventive concept (s) herein taught, and because many modifications may be made in the embodiment herein detailed in accordance with the descriptive requirements of the law, it is to be understood that the details herein are to be interpreted as illustrative and not in a limiting sense.

What is claimed is:

1. An Ankle Massaging Device comprising a flexible member having two legs and a curved portion connecting the two legs while the flexible member is constructed in the general shape of a "U" and further dimensioned so that each leg of the "U" is placed on either side of a user's ankle while the curve section of the "U" shaped flexible member rest on a top of a user's foot, wherein said curved portion further comprises a means for urging each end together thereby providing a means for securely holding the device on a user's ankle further comprising massaging mechanisms mounted in an interior cavity on an end portion of each leg, furthermore the end portions having an interior surface area which contacts a surface of the user's ankle, a multiplicity of massaging protrusions mounted on the interior surface of each end and positioned so that the massaging protrusions are aligned with menstrual cycle cramp pressure points on the user's ankle.

2. The Ankle Massaging Device of claim 1, wherein said massaging mechanism mounted in each interior cavity further comprises a battery powered motorized vibrating massaging mechanism mounted in each interior cavity of each end portion of each leg.

3. The Ankle Massaging Device of claim 1, wherein said multiplicity of massaging protrusions further comprises three massaging protrusions on each interior surface of the end portions of each leg.

* * * * *